US005161273A

United States Patent [19]

Deck

[11] Patent Number: 5,161,273

[45] Date of Patent: Nov. 10, 1992

[54] NEONATAL CRADLE

[75] Inventor: Gene C. Deck, San Antonio, Tex.

[73] Assignee: The United States of America as represented by the Secretary of the Air Force, Washington, D.C.

[21] Appl. No.: 877,672

[22] Filed: May 1, 1992

[51] Int. Cl.[5] ..... A47D 13/00

[52] U.S. Cl. ..... 5/601; 5/603; 5/655; 5/925

[58] Field of Search ..... 5/601, 655, 600, 630, 5/643, 646, 648, 101, 603, 925; 378/209, 180, 208

[56] References Cited

U.S. PATENT DOCUMENTS

| | | | |
|---|---|---|---|
| 2,700,381 | 1/1955 | Powell | 5/603 |
| 2,777,138 | 1/1957 | Gallagher | 5/655 |
| 2,973,889 | 3/1961 | Phillips | 5/655 |
| 4,254,518 | 5/1981 | Buhren et al. | 5/450 |
| 4,383,713 | 5/1983 | Roston | 297/219 |
| 4,510,634 | 4/1985 | Diedrich et al. . | |
| 4,631,766 | 12/1986 | Semmler et al. | 5/603 |
| 4,790,041 | 12/1988 | Shtull | 5/603 |
| 4,873,735 | 10/1989 | Fermaglich et al. | 5/603 |
| 4,958,393 | 9/1990 | Brecher | 5/603 |
| 4,972,532 | 11/1990 | Juan | 5/94 |

*Primary Examiner*—Alexander Grosz

*Attorney, Agent, or Firm*—Bobby D. Scearce; Donald J. Singer

[57] ABSTRACT

A neonatal cradle is described which comprises a plastic first plate member formed to a V shaped trough defined by a two adjoining surfaces disposed at about 105°, a foam layer on the first member, a support member having a central notch for positioning and elevating one end of the first member, strips of slip resistant materials between the first member, foam layer and support member, and a restraining belt on the first member.

8 Claims, 2 Drawing Sheets

NEONATAL CRADLE

RIGHTS OF THE GOVERNMENT

The invention described herein may be manufactured and used by or for the Government of the United States for all governmental purposes without the payment of any royalty.

BACKGROUND OF THE INVENTION

The present invention relates generally to devices for handling newborn babies, and more particularly to a neonatal cradle configured to enhance environmental stimuli of neonates.

During prolonged hospital confinement of a critically ill neonate, the observable environment of the neonate is generally limited to a few square feet and the cognitive stimuli for the neonate usually consists only of the overhead ceiling or heating device because of the restrictive nature of monitor cabling, breathing tubes, cannula, IVs, and the like.

The invention is a cradle configured to enhance cognitive stimuli and thereby to promote neonatal development by allowing the neonate to observe more of its immediate surroundings. In a preferred embodiment, the invention comprises a generally rectangular plate of clear plastic material formed to a V-shaped cradle defined by two adjoining surfaces disposed at about 105°. A foam layer may be included in the cradle for comfort of the neonate. A support member having a central notch supports and elevates one end of the cradle. Strips of slip resistant materials interfacing the cradle and foam layer and support member may be included to prevent slippage between the members. Flexible belts attached to the cradle provide protective restraint to the neonate. The invention may be used principally as a cradle and lifting or handling member for newborns and, additionally, as a convenient positioning platform for performing radiographic or other medical procedures with minimum handling of the neonate. The invention is light in weight, simple in design and structure, convenient in use and inexpensive in manufacture.

It is therefore a principal object of the invention to provide an improved infant carrier.

It is a further object of the invention to provide a neonatal cradle for supporting a neonate for enhancement of environmental awareness of the neonate.

It is yet another object of the invention to provide a device for conveniently handling a neonate in the performance of medical procedures thereon.

These and other objects of the invention will become apparent as a detailed description of representative embodiments proceeds.

SUMMARY OF THE INVENTION

In accordance with the foregoing principles and objects of the invention, a neonatal cradle is described which comprises a plastic first plate member formed to a V shaped trough defined by a two adjoining surfaces disposed at about 105° , a foam layer on the first member, a support member having a central notch for positioning and elevating one end of the first member, strips of slip resistant materials between the first member, foam layer and support member, and a restraining belt on the first member.

DESCRIPTION OF THE DRAWINGS

The invention will be more clearly understood from the following detailed description of representative embodiments thereof read in conjunction with the accompanying drawings wherein.

DETAILED DESCRIPTION

Figure 1:
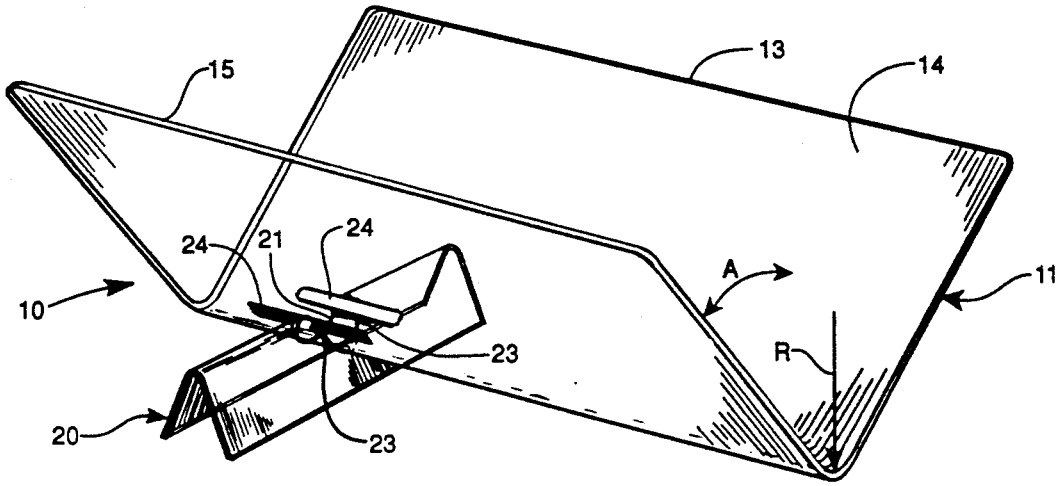
FIG 1 is a perspective view of a preferred embodiment of the invention.
Figure 2:
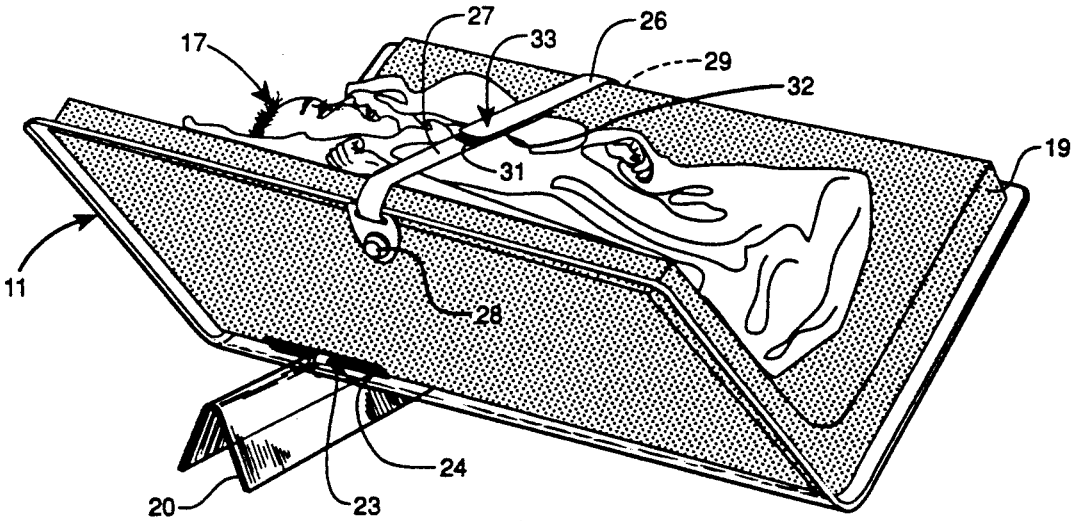
FIG. 2 is a perspective view of the FIG. 1 embodiment with a neonate positioned thereon.

Referring now to FIG. 1, shown therein is a perspective view of a preferred embodiment of the neonatal cradle taught herein. FIG. 2 shows the FIG. 1 embodiment supporting a neonate thereon. In FIG. 1, cradle 10 comprises a first member 11 formed from a generally rectangular plate 13 into a V-shaped trough defined by two adjoining surfaces 14,15 disposed at angle A of size (about 100° to 110°) to comfortably accommodate neonate 17 and preferably about 105°, which angle is preferable as substantially preventing neonate 17 from rolling over on his/her own. A radius of curvature R at which surfaces 14,15 adjoin of about 2 to 3 inches was found to comfortably accommodate and position neonate 17. The material for plate 13 is not limiting of the invention and may preferably comprise a transparent substantially rigid plastic material such as Lexan TM, Plexiglas TM or similar material. The selected material is also preferably x-ray transparent in order to facilitate use of member 11 as a radiographic platform so that the neonate need not be removed therefrom in order to perform radiographic work. Plate 13 may be any suitable size sufficient to comfortably accommodate the neonate, i.e. about 18–28 inches by 18–24 inches; in a unit built in demonstration of the FIG. 1 embodiment, member 11 was about 20 inches long and defined by surfaces 14,15 each about ¼ inch thick and 9 inches wide, which width is about maximum for allowing neonate 17 a maximum field of view and for being received within most commercial neonatal warmers while retaining a desirable degree of portability. As suggested in FIG. 2, suitably sized foam layer 19 of eggcrate foam, Medical TEMPER TM foam or the like may be applied to member 11 for the comfort of neonate 17.

A second member 20 is used in conjunction with member 11 in order to support and stabilize member 11 near one one thereof at a selectable angle of about 25°–35° to a supporting surface, which range of angle includes a medically prescribed angle for retarding reflux in neonate 17, and provides neonate 17 with a view of the surroundings without risking a rocking motion. In the demonstration unit, member 20 comprised a piece of Plexiglas TM plate material about 18×9×¼ inches formed to an inverted V shape as suggested in FIGS. 1,2. Central notch 21 of suitable size was formed in member 20 to stabilize member 11 thereon and to support member 11 at the desired angle. As seen most clearly in FIG. 1, one or more strips 23 of non-slip material may be applied to the top of member 20 and strips 24 to the under surface of member 11 at corresponding locations to provide means to prevent slippage between members 11,20 in supporting neonate 17. Non-slip strips may also interface member 11 and layer 19 to prevent slippage therebetween. Materials for strips 23,24 may include, but are not limited to, sponge rubber, grit tape, Velcro TM or other material as would occur to the skilled artisan practicing the invention.

Appropriate restraining means for neonate 17 may be included in the invention and may comprise means such as a pair of belts 26,27 attached at corresponding ends to member 11 at attachment brackets 28,29, and may further comprise suitable means such as a clasp or buckle (not shown) or the hook 31 and loop 32 material defining a Velcro TM fastener 33 shown in FIG. 2, for detachably joining belts 26,27.

Figure 3:
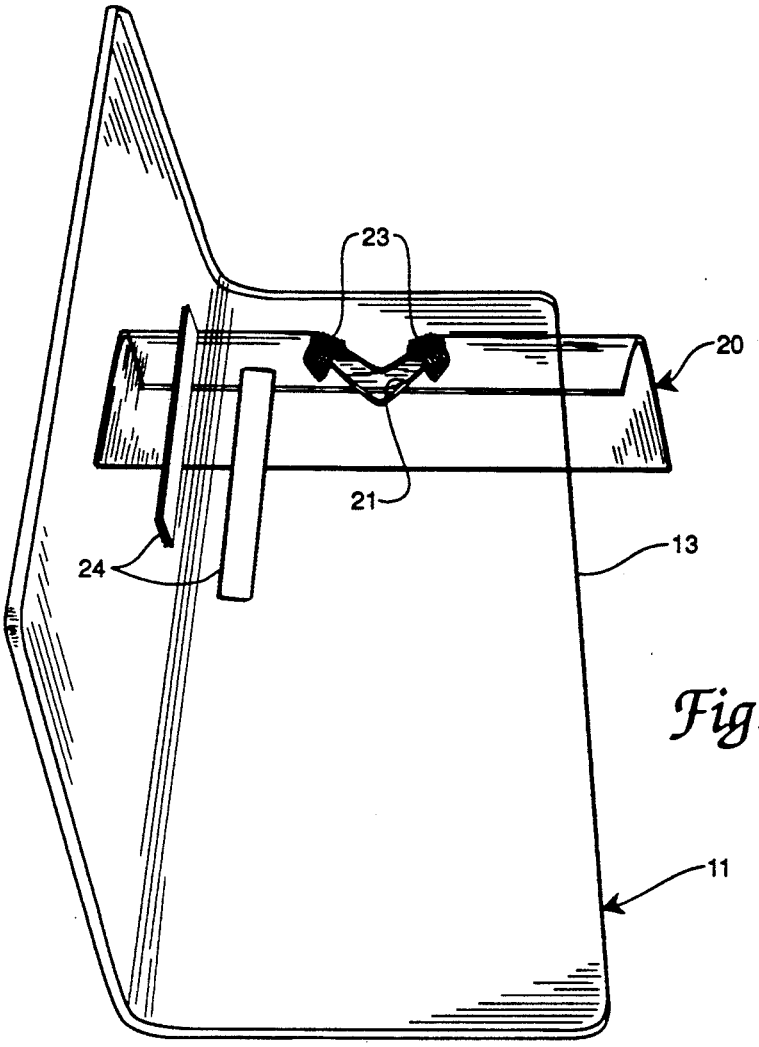
FIG. 3 is a perspective view of the FIG. 1 embodiment in an orientation for radiography or other medical examination.

As suggested above, the invention may be used principally as a cradle for supporting, lifting and handling newborns. However, member 11 may also be used as a convenient positioning platform for performing medical procedures with a minimum of handling of neonate 17. For example, as suggested in FIG. 3, member 11 may be rotated to an orientation at which one of the sides defining surfaces 14 or 15 lies flat on member 20 or on a surface defining a medical examination table, radiographic platform or the like, which allows examination or radiography of neonate 17 in lateral views without repositioning neonate 17 on member 11.

Figure 4:
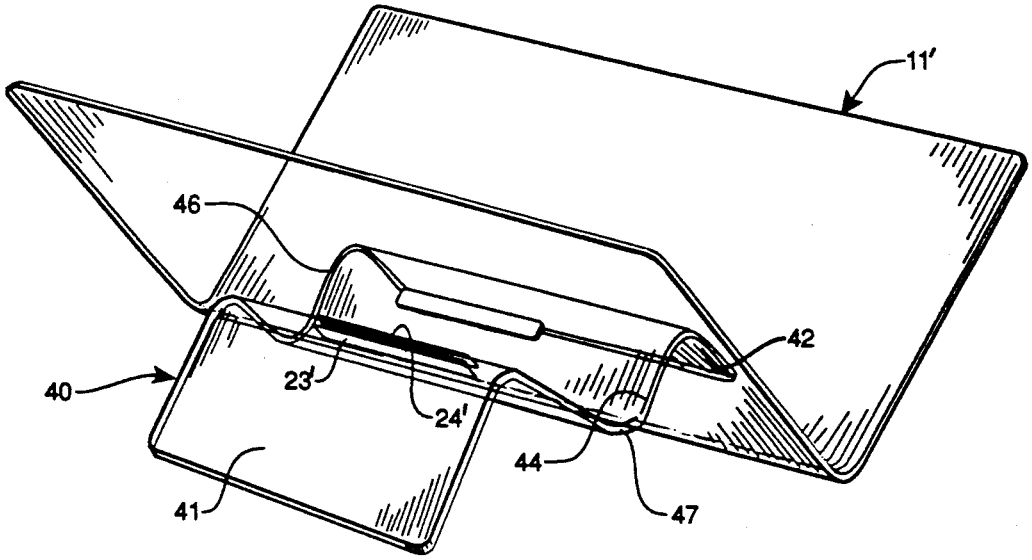
FIG. 4 is a perspective view of an alternative embodiment of the invention.

Referring now to FIG. 4, shown therein is a perspective view of another embodiment of the invention comprising an alternative structure for supporting a neonate at the desired angle relative to a supporting surface. In FIG. 4, member 11' is supported at a desired angle by an alternatively configured support member 40 comprising a plastic plate member formed to the shape suggested including a pair of leg portions 41,42 with depression 44 defined therebetween of size and shape and inclined from one end 46 to the other end 47 to receive member 11' at the desired angle. Slip resistant strips 23'24' may be included to prevent slippage between members 11',40. Member 40 may provide more stability than does member 20 of FIGS. 1,2,3, but is less adjustable in angle of inclination for the neonate.

The invention therefore provides a cradle for conveniently positioning, handling and lifting neonates. The invention has an advantage of being selectively positionable to promote cognitive awareness in critically ill neonates by maximizing the observable environment of the neonate, and allows machine dependent neonates to be positioned without monitoring lead entanglement or risk of catheter, airway or IV extraction. Further, handling the neonate in the cradle minimizes any risk of accidental extraction of IVs, catheters, airway and feeding tubes or other functions of disconnection of vital signs monitoring devices.

It is understood that modifications to the invention may be made as might occur to one with skill in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

I claim:

1. A neonatal cradle, comprising:

(a) a plastic first plate member formed to a trough shape having first and second ends and defined by a two adjoining generally rectangular and planar surfaces disposed at an angle therebetween in the range of 100° to 110°, said first plate member sized to receive a neonate; and (b) a second support member for supporting said first plate member on a supporting surface at a selected angle in the range of 25° to 35° from one of said first and second ends to the other.

2. The cradle of claim 1 wherein said first plate member comprises a plastic material substantially transparent to x-ray.

3. The cradle of claim 1 further comprising a foam layer on said first member.

4. The cradle of claim 1 wherein said angle is 105°.

5. The cradle of claim 4 wherein said two adjoining surfaces define a radius of curvature therebetween in the range of 2 to 3 inches.

6. The cradle of claim 1 further comprising a layer of slip resistant material between said first plate member and said second support member to prevent said first plate member from slipping on said second support member.

7. The cradle of claim 1 further comprising restraining means on said first plate member for securing a neonate thereon.

8. The cradle of claim 7 wherein said restraining means comprises a pair of belts attached at corresponding ends to respective said adjoining surfaces, and joining means for detachably joining said belts.

* * * * *